United States Patent [19]

Daly et al.

[11] Patent Number: 4,991,558

[45] Date of Patent: Feb. 12, 1991

[54] IDLE AND OFF-IDLE OPERATION OF A TWO-STROKE FUEL-INJECTED MULTI-CYLINDER INTERNAL COMBUSTION ENGINE

[75] Inventors: Paul D. Daly, Troy; Douglas R. Verner; Mark A. Brooks, both of Sterling Heights; Robert E. Fallis, Milford, all of Mich.

[73] Assignee: Siemens Automotive L.P., Troy, Mich.

[21] Appl. No.: 461,557

[22] Filed: Jan. 5, 1989

[51] Int. Cl.[5] ..... F02D 7/00

[52] U.S. Cl. ..... 123/481; 123/73 C

[58] Field of Search ..... 123/73 A, 73 C, 198 F, 123/481

[56] References Cited

U.S. PATENT DOCUMENTS

| | | | |
|---|---|---|---|
| 2,771,867 | 11/1956 | Peras | 123/481 |
| 4,103,655 | 8/1978 | Coles | 123/481 |
| 4,172,434 | 10/1979 | Coles | 123/481 |
| 4,434,767 | 3/1984 | Kohama et al. | 123/198 F |
| 4,489,695 | 12/1984 | Kohama et al. | 123/198 F |
| 4,509,488 | 4/1985 | Förster et al. | 123/198 F |
| 4,768,474 | 9/1988 | Fujimoto et al. | 123/198 F |

FOREIGN PATENT DOCUMENTS

| | | | |
|---|---|---|---|
| 2653014 | 5/1978 | Fed. Rep. of Germany | 123/198 F |
| 0110732 | 7/1982 | Japan | 123/481 |
| 0203846 | 11/1984 | Japan | 123/198 F |
| 0994789 | 2/1983 | U.S.S.R. | 123/198 F |
| 2122682 | 1/1984 | United Kingdom | 123/481 |
| 8300900 | 3/1983 | World Int. Prop. O. | 123/481 |

*Primary Examiner*—Tony M. Argenbright
*Assistant Examiner*—Robert E. Mates
*Attorney, Agent, or Firm*—George L. Boller; Russel C. Wells

[57] ABSTRACT

A multiple cylinder two-stroke fuel-injected internal combustion engine is operated at idle by interrupting the fuel injection stages in a predetermined pattern such that over a certain number of crankshaft revolutions a fewer number of injections occur than over the same number of revolutions at non-idle. The quantity of fuel injected per injection is increased relative to that required to operate the engine at idle without any injection interruptions. Spark timing is also advanced.

16 Claims, 1 Drawing Sheet

| CRANK REVS. | CYL. 1 | 2 | 3 | 4 | 5 | 6 |
|---|---|---|---|---|---|---|
| 1 | S | I | I | S | I | S |
| 2 | I | I | S | I | S | I |
| 3 | I | S | I | S | I | I |
| 4 | S | I | S | I | I | S |
| 5 | I | S | I | I | S | I |
| 6 | S | I | I | S | I | S |
| 7 | I | I | S | I | S | I |
| ⋮ | | | | | | |

| CRANK REVS. | CYL. 1 | 2 | 3 | 4 | 5 | 6 |
|---|---|---|---|---|---|---|
| 1 | I | S | S | I | S | I |
| 2 | S | S | I | S | I | S |
| 3 | S | I | S | I | S | S |
| 4 | I | S | I | S | S | I |
| 5 | S | I | S | S | I | S |
| 6 | I | S | S | I | S | I |
| 7 | S | S | I | S | I | S |
| ⋮ | | | | | | |

| CRANK REVS. | CYL. 1 | 2 | 3 | 4 |
|---|---|---|---|---|
| 1 | I | S | I | I |
| 2 | S | I | S | I |
| 3 | I | S | I | S |
| 4 | I | I | S | I |
| 5 | S | I | I | S |
| 6 | I | S | I | I |
| 7 | S | I | S | I |
| ⋮ | | | | |

| CRANK REVS. | CYL. 1 | 2 | 3 | 4 |
|---|---|---|---|---|
| 1 | S | I | S | S |
| 2 | I | S | I | S |
| 3 | S | I | S | I |
| 4 | S | S | I | S |
| 5 | I | S | S | I |
| 6 | S | I | S | S |
| 7 | I | S | I | S |
| ⋮ | | | | |

IDLE AND OFF-IDLE OPERATION OF A TWO-STROKE FUEL-INJECTED MULTI-CYLINDER INTERNAL COMBUSTION ENGINE

BACKGROUND AND SUMMARY OF THE INVENTION

When running at idle, an internal combustion engine is only lightly loaded and therefore ingests fuel at a rate that is small in comparison to rates that are required at higher speeds and loads. When fuel is introduced into the engine cylinders by means of an individual electronically controlled fuel injector for each cylinder, each injector is required to operate over a rather extensive range of opening and closing times. In order to operate the engine at high speeds and loads, it is vital that each injector have the ability to flow fuel at a certain flow rate; yet at idle, a much lower flow rate is used. Stated another way, such an injector is required to have a relatively large dynamic range. Where a particular injector is designed for a specific maximum flow rate, it may be difficult for such an injector to accurately inject fuel at the low end of the required range. This difficulty is amplified in a two-stroke engine.

A further consideration related to a two-stroke engine involves the matter of scavenging. The inherent nature of the design of a two-stroke engine leaves a significant amount of residual combustion products in a combustion chamber as the chamber is being prepared for the immediately succeeding combustion event. The presence of such residual products influences the nature of the combustion process, and when a two-stroke engine is used as the powerplant of an automotive vehicle, factors such as fuel economy and exhaust emissions are affected. A known means of improving scavenge efficiency and increasing the quantity of fuel injected per cycle is to retard the spark timing.

The present invention relates to means and methodology for improving the operation of a multi-cylinder fuel-injected two-stroke internal combustion engine at idle and off-idle. The invention involves the deliberate skipping of injection cycles in particular patterns which serve to create modest, but nonetheless meaningful, improvements in operating efficiency and exhaust emissions without causing any noticeable degradation in the quality of the engine's operation at idle. Briefly, the pattern is such that over a certain number of engine crankshaft revolutions the interruptions of fuel injection into each individual cylinder are caused to occur at non-consecutive two-stroke cycles and the interruptions in the sequence of injection from cylinder to cylinder are caused to occur non-consecutively. Each interrupted injection results in the introduction of air alone into the associated cylinder on the immediately succeeding cycle whereby the residual combustion products are diluted by the charge of air. The scavenging that occurs after the interrupted fuel injection cycle therefore results in a cylinder that is much better purged of combustion products before the next combustion event that takes place in that cylinder. Accordingly, that combustion event will make more efficient use of the injected charge of fuel.

Since the idle load that is imposed on the engine requires a certain power output from the engine, the skipping of certain injection cycles at idle means that on the average each combustion event in each cylinder must produce a higher power output in comparison to the situation where injection cycles are not skipped. This higher power output is accomplished by causing each injector to flow a correspondingly higher amount of fuel when the injection skipping pattern is in effect at idle. Two benefits result from the invention. One, it means that the lower limit of the fuel injectors' dynamic ranges does not have to be as low as in the case of non-skipping, and two, it means that the spark timing can be advanced over the value used for non-skip operation. Reducing the dynamic range requirement of a fuel injector is an advantage for obvious reasons, and the advancement of spark timing of course promotes better combustion efficiency and fuel economy.

The features of the invention that have been mentioned above, along with further ones, will be seen in the ensuing detailed description of a presently preferred embodiment of the invention. The description includes the best mode contemplated at the present time for the practice of the invention. As an aid to explaining the inventive principles, a drawing accompanies the disclosure.

DESCRIPTION OF THE PREFERRED EMBODIMENT

Figures 1, 2, 3, 4, 5:
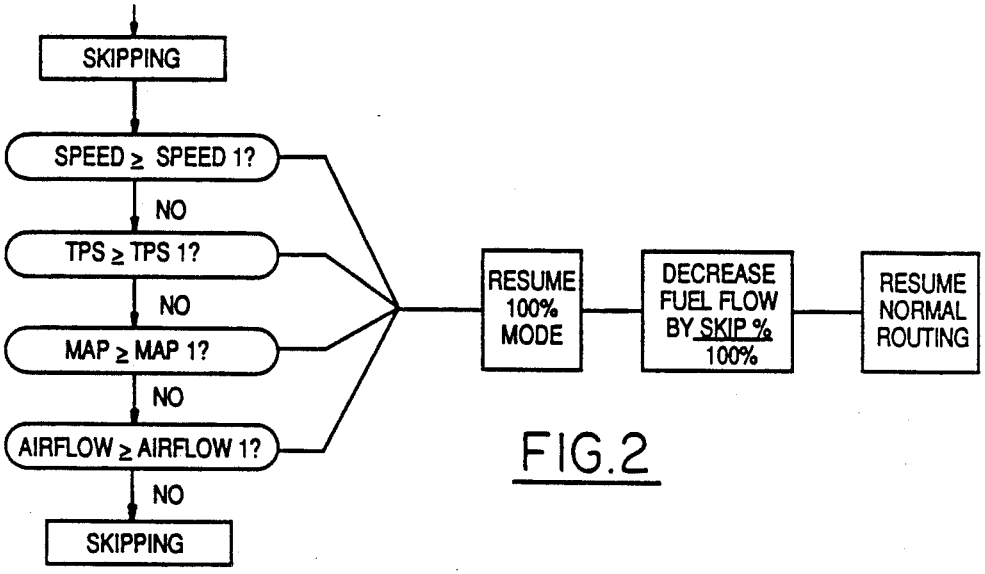
FIG. 1 is a chart portraying a fuel injection pattern of operation for a six-cylinder, two-stroke engine.
FIG. 2 is a flow diagram of a micro-computer routine illustrating off-idle operation.
FIG. 3 is a chart portraying another fuel injection pattern of operation for a six-cylinder, two-stroke engine.
FIG. 4 is a chart portraying a fuel injection pattern of operation for a four-cylinder, two-stroke engine.
FIG. 5 is a chart portraying another fuel injection pattern of operation for a four-cylinder, two-stroke engine.

FIG. 1 presents a fuel injection pattern for a six-cylinder, fuel-injected, two-stroke engine operating at idle. The order in which the cylinders are sequentially injected when the engine is running at non-idle is: cylinder #1, cylinder #2, cylinder #3, cylinder #4, cylinder #5, cylinder #6. This sequential pattern of injection is altered at engine idle by the selective skipping of injections according to the pattern portrayed. The letter I designates the occurrence of injection by operation of the corresponding injector, while the letter S denotes the skipping of an injection by the non-operation of the corresponding injector. Thus, in FIG. 1, the abscissa represents the engine cylinders, and the ordinate, the crankshaft revolutions.

The sequence of FIG. 1 comprises the repeating pattern: skip, inject, inject, skip, inject. Hence, after the injection of cylinder #5 during crankshaft revolution #1, the pattern repeats, beginning with the skipping of cylinder #6 during crankshaft revolution #I and ending with the injection of cylinder #4 during crankshaft revolution #2. In similar fashion, occurrences of the pattern end with the injection of cylinder #3 during crankshaft revolution #3, with the injection of cylinder #2 during crankshaft revolution #4, with the injection of cylinder #1 during crankshaft revolution #5, and with the injection of cylinder #6 during crankshaft revolution #5. As subsequently appears, the pattern that occurs during crankshaft revolution #6 is identical to that occurring during crankshaft revolution #1, the pattern that occurs during crankshaft revolution #7 is identical to that occurring during crankshaft revolution #2, and so forth.

It is to be observed that over a certain number of engine crankshaft revolutions the interruptions in each individual cylinder are caused to occur at non-consecutive two-stroke cycles and the interruptions in the sequence of injection from cylinder to cylinder are caused to occur non-consecutively. In other words, as a function of time, there are never two consecutive interruptions, nor does any cylinder experience interruptions on consecutive crankshaft revolutions. The pattern produces an average injector operating rate of 60% as compared with the 100% rate that occurs at non-idle. To maintain the power necessary to operate the engine at idle, the amount of fuel injected per injection is increased over that which would otherwise be required In this way each injector is not required to meter as low an amount of fuel as would otherwise be the case, and therefore can be more precise. Because each combustion event must deliver more power output than would otherwise be the case, spark timing can be advanced to improve combustion efficiency. Thus, definite advantages accrue by utilization of the invention.

Because a skipped injection cycle would be noticeable at non-idle, deliberate skipping is permitted only at idle. Therefore, when the engine leaves idle, such departure from idle must be detected and the fuel delivery to the individual injectors re-adjusted. Since the injectors are electronically controlled, typically by a digital micro-computer control, a suitable routine is embodied in the micro-computer, and an example of such a routine is presented in FIG. 2. Parameters indicative of departure from idle operation are monitored and use to revert the micro-computer control to non-idle operation. The illustrated routine monitors engine speed, throttle position, manifold absolute pressure, and airflow into the engine. Change in any one of these monitored parameters that is indicative of a change from idle to non-idle operation will revert the micro-computer to non-idle operation. From the standpoint of fuel injection, one of the importance consequences of such reversion is to remove the fuel flow adjustment factor that was instituted upon idle operation due to the reduced percentage of injector operations. There is of course a complementary routine that caused the fuel flow adjustment factor to be instituted upon detection of idle operation. Simultaneously, spark timing is adjusted.

It is possible that an engine could be operated at idle with less than the 60% injector operation represented by FIG. 1. FIG. 3 represents a pattern that is the inverse of that of FIG. 1 and hence represents 40% injector operation. According to this pattern, over a certain number of engine crankshaft revolutions the injections in each individual cylinder are caused to occur at non-consecutive two-stroke cycles, and the injections in the sequence of injections from cylinder to cylinder are caused to occur non-consecutively. In this mode of operation suitable adjustments in fuel flow factor, and spark timing, are made in analogous manner to those previously described in connection with operation according to FIG. 1.

FIG. 4 discloses an injector operating pattern for the idle operation of a four-cylinder, two-stroke engine. The designation I identifies an injection while the designation S denotes a skip. The cylinder injection order is cylinder #1, cylinder #2, cylinder #3, and cylinder #4. The repeated sequence is inject, skip, inject, inject, skip so that the crankshaft must rotate five times before the sequence during a single revolution is the same again. The adjustments to fuel flow factor, and spark timing, are made in analogous manner to those described for the six-cylinder engine. As in the embodiment of FIG. 1, over a certain number of engine crankshaft revolutions the interruptions in each individual cylinder are caused to occur at non-consecutive two-stroke cycles and the interruptions in the sequence of injection from cylinder to cylinder are caused to occur non-consecutively. In other words, as a function of time, there are never two consecutive interruptions, nor does any individual cylinder experience interruptions on consecutive crankshaft revolutions.

FIG. 5 presents an operating pattern which is complementary to the pattern of FIG. 4. Over a certain number of engine crankshaft revolutions the injections in each individual cylinder are caused to occur at non-consecutive two-stroke cycles and the injections in the sequence of injection from cylinder to cylinder are caused to occur non-consecutively. As a result, there are never two consecutive injections, nor does any cylinder experience injections on consecutive crankshaft revolutions.

While a presently preferred embodiment of the invention has been disclosed, it must be appreciated that principles of the invention may be practiced in other equivalent embodiments.

What is claimed is:

1. In a multiple-cylinder, two-stroke, fuel-injected internal combustion engine, means for operating the engine at idle which comprises means for interrupting the fuel injection stages in a predetermined pattern such that over a certain number of engine crankshaft revolutions a fewer number of injection stages occur than over the same number of engine crankshaft revolutions during non-idle operation, and means for increasing the quantity of fuel injected per injection stage relative to the quantity of fuel required per injection stage to secure idle operation without any injection interruptions.

2. An internal combustion engine as set forth in claim 13 including means for advancing the spark timing during idle operation in comparison to the spark timing that is appropriate for idle operation without any interruption of the injection stages.

3. A method for engine idle operation of a multiple-cylinder, two-cycle, fuel injected internal combustion engine, said method comprising: interrupting the fuel injection stages in a predetermined pattern such that over a certain number of engine crankshaft revolutions a fewer number of injection stages occur than over the same number of engine crankshaft revolutions during non-idle operation, and increasing the quantity of fuel injected per injection stage relative to the quantity of fuel required per injection stage to secure idle operation without any injection interruptions.

4. The method as set forth in claim 3 including advancing the spark timing during idle operation in comparison to the spark timing that is appropriate for idle operation without any interruption of the injection stages.

5. A method for engine idle operation of a six-cylinder, two-stroke, fuel-injected internal combustion engine which operates at non-idle in a manner such that the fuel is injected into each cylinder during the fuel injection stage of consecutive two-stroke cycles of the cylinder, said method for engine idle operation comprising: interrupting the fuel injection stages of the cylinders from that which occurs at non-idle engine operation in such a pattern that over a certain number of engine crankshaft revolutions the interruptions in each individual cylinder are caused to occur at non-consecutive two-stroke cycles and the interruptions in the sequence of injection from cylinder to cylinder are caused to occur non-consecutively, with said method further comprising the interruptions and injections occurring in the following repeating sequence that covers five-sixths of an engine crankshaft revolution; interrupt, inject, inject, interrupt, inject.

6. A method for engine idle operation of a four-cylinder, two-stroke, fuel-injected internal combustion engine which operates at non-idle in a manner such that the fuel is injected into each cylinder during the fuel injection stage of consecutive two-stroke cycles of the cylinder, said method for engine idle operation comprising: interrupting the fuel injection stages of the cylinders from that which occurs at non-idle engine operation in such a pattern that over a certain number of engine crankshaft revolutions the interruptions in each individual cylinder are caused to occur at non-consecutive two-stroke cycles and the interruptions in the sequence of injection from cylinder to cylinder are caused to occur non-consecutively, with said method further comprising the interruptions and injections occurring in the following repeating sequence that covers one and one-fourth engine crankshaft revolutions; inject, interrupt, inject, inject, interrupt.

7. In a six-cylinder, two-stroke, fuel-injected internal combustion engine which comprises means for causing operation at non-idle in a manner such that the fuel is injected into each cylinder during the fuel injection stage of consecutive two-stroke cycles of the cylinder, the means for operating the engine at idle which comprises: means for interrupting the fuel injection stages of the cylinders from that which occurs at non-idle engine operation in such a pattern that over a certain number of engine crankshaft revolutions the interruptions in each individual cylinder are caused to occur at non-consecutive two-stroke cycles and the interruptions in the sequence of injection from cylinder to cylinder are caused to occur non-consecutively, and the means for interrupting the fuel injection stages of the cylinders comprises means for causing the injections and interruptions to occur in the following repeating sequence that covers five-sixths of an engine crankshaft revolution: interrupt, inject, inject, interrupt, inject.

8. In a four-cylinder, two-stroke, fuel-injected internal combustion engine which comprises means for causing operation at non-idle in a manner such that the fuel is injected into each cylinder during the fuel injection stage of consecutive two-stroke cycles of the cylinder, the means for operating the engine at idle which comprises: means for interrupting the fuel injection stages of the cylinders from that which occurs at non-idle engine operation in such a pattern that over a certain number of engine crankshaft revolutions the interruptions in each individual cylinder are caused to occur at non-consecutive two-stroke cycles and the interruptions in the sequence of injection from cylinder to cylinder are caused to occur non-consecutively, and the means for interrupting the fuel injection stages of the cylinders comprises means for causing the injections and interruptions to occur in the following repeating sequence that covers one and one-forth engine crankshaft revolutions: inject, interrupt, inject, inject, interrupt.

9. A method for engine idle operation of a six-cylinder, two-stroke, fuel-injected internal combustion engine which operates at non-idle in a manner such that the fuel is injected into each cylinder during the fuel injection stage of consecutive two-stroke cycles of the cylinder, said method for engine idle operation comprising: interrupting the fuel injection stages of the cylinders from that which occurs at non-idle engine operation in such a pattern that over a certain number of engine crankshaft revolutions the injections into each individual cylinder are caused to occur at non-consecutive two-stroke cycles and the injections in the sequence of injection from cylinder to cylinder are caused to occur non-consecutively with said method further comprising the interruptions and injections occurring in the following repeating sequence that covers five-sixths of an engine crankshaft revolution: inject, interrupt, interrupt, inject, interrupt.

10. A method for engine idle operation of a four-cylinder, two-stroke, fuel-injected internal combustion engine which operates at non-idle in a manner such that the fuel is injected into each cylinder during the fuel injection stage of consecutive two-stroke cycles of the cylinder, said method for engine idle operation comprising: interrupting the fuel injection stages of the cylinders from that which occurs at non-idle engine operation in such a pattern that over a certain number of engine crankshaft revolutions the injections into each individual cylinder are caused to occur at non-consecutive two-stroke cycles and the injections in the sequence of injection from cylinder to cylinder are caused to occur non-consecutively with said method further comprising the interruptions and injections occurring in the following repeating sequence that covers one and one-fourth engine crankshaft revolutions: interrupt, inject, interrupt, interrupt, inject.

11. In a six-cylinder, two-stroke, fuel-injected internal combustion engine which comprises means for causing operation at non-idle in a manner such that the fuel is injected into each cylinder during the fuel injection stage of consecutive two-stroke cycles of the cylinder, the means for operating the engine at idle which comprises: means for interrupting the fuel injection stages of the cylinders from that which occurs at non-idle engine operation in such a pattern that over a certain number of engine crankshaft revolutions the injections in each individual cylinder are caused to occur at non-consecutive two-stroke cycles and the injections in the sequence of injection from cylinder to cylinder are caused to occur non-consecutively, and the means for interrupting the fuel injection stages of the cylinders comprises means for causing the injections and interruptions to occur in the following repeating sequence that covers five-sixths of an engine crankshaft revolution: inject, interrupt, interrupt, inject, interrupt.

12. In a four-cylinder, two-stroke, fuel-injected internal combustion engine which comprises means for causing operation at non-idle in a manner such that the fuel is injected into each cylinder during the fuel injection stage of consecutive two-stroke cycles of the cylinder, the means for operating the engine at idle which comprises: means for interrupting the fuel injection stages of the cylinders from that which occurs at non-idle engine operation in such a pattern that over a certain number of engine crankshaft revolutions the injections in each individual cylinder are caused to occur at non-consecutive two-stroke cycles and the injections in the sequence of injection from cylinder to cylinder are caused to occur non-consecutively, and the means for interrupting the fuel injection stages of the cylinders comprises means for causing the injections and interruptions to occur in the following repeating sequence that covers one and one-fourth engine crankshaft revolutions: interrupt, inject, interrupt, interrupt, inject.

13. A method for engine idle operation of a multiple-cylinder, two-stroke, fuel-injected internal combustion engine which operates at non-idle in a manner such that the fuel is injected into each cylinder during the fuel injection stage of consecutive two-stroke cycles of the cylinder, said method for engine idle operation comprising: interrupting the fuel injection stages of the cylinders from that which occurs at non-idle engine operation in such a pattern that over a certain number of engine crankshaft revolutions the interruptions in each individual cylinder are caused to occur at non-consecutive two-stroke cycles and the interruptions in the sequence of injection from cylinder to cylinder are caused to occur non-consecutively, with said method further comprising the interruptions and injections occurring in a repeating sequence that spans a certain continuum of engine crankshaft revolution, said sequence being characterized in that an injection occurs at one limit of the sequence and an interruption occurs at the opposite limit of the sequence and in that said sequence comprises two consecutive injections.

14. In a multi-cylinder, two-stroke, fuel-injected internal combustion engine which comprises means for causing operation at non-idle in a manner such that the fuel is injected into each cylinder during the fuel injection stage of consecutive two-stroke cycles of the cylinder, the means for operating the engine at idle which comprises: means for interrupting the fuel injection stages of the cylinders from that which occurs at non-idle engine operation in such a pattern that over a certain number of engine crankshaft revolutions the interruptions in each individual cylinder are caused to occur at non-consecutive two-stroke cycles and the interruptions in the sequence of injection from cylinder to cylinder are caused to occur non-consecutively, and the means for interrupting the fuel injection stages of the cylinders comprises means for causing the injections and interruptions to occur in a repeating sequence that spans a certain continuum of engine crankshaft revolution, said sequence being characterized in that an injection occurs at one limit of the sequence and an interruption occurs at the opposite limit of the sequence and in that said sequence comprises two consecutive injections.

15. A method for engine idle operation of a multiple-cylinder, two-stroke, fuel-injected internal combustion engine which operates at non-idle in a manner such that the fuel is injected into each cylinder during the fuel injection stage of consecutive two-stroke cycles of the cylinder, said method for engine idle operation comprising: interrupting the fuel injection stages of the cylinders from that which occurs at non-idle engine operation in such a pattern that over a certain number of engine crankshaft revolutions the interruptions in each individual cylinder are caused to occur at non-consecutive two-stroke cycles and the interruptions in the sequence of injection from cylinder to cylinder are caused to occur non-consecutively, with said method further comprising the interruptions and injections occurring in a repeating sequence that spans a certain continuum of engine crankshaft revolution, said sequence being characterized in that an injection occurs at one limit of the sequence and an interruption occurs at the opposite limit of the sequence, in that said sequence comprises plural injections, in that said plural injections are non-consecutive, and in that said sequence comprises a pattern of injections and interruptions other than a pattern that is sub-divisible into identical sub-sequences.

16. In a multi-cylinder, two-stroke, fuel-injected internal combustion engine which comprises means for causing operation at non-idle in a manner such that the fuel is injected into each cylinder during the fuel injection stage of consecutive two-stroke cycles of the cylinder, the means for operating the engine at idle which comprises: means for interrupting the fuel injection stages of the cylinders from that which occurs at non-idle engine operation in such a pattern that over a certain number of engine crankshaft revolutions the interruptions in each individual cylinder are caused to occur at non-consecutive two-stroke cycle and the interruptions in the sequence of injection from cylinder to cylinder are caused to occur non-consecutively, and the means for interrupting the fuel injection stages of the cylinders comprises means for causing the injections and interruptions to occur in a repeating sequence that spans a certain continuum of engine crankshaft revolution, said sequence being characterized in that an injection occurs at one limit of the sequence and an interruption occurs at the opposite limit of the sequence, in that said sequence comprises plural injections, in that said plural injections are non-consecutive, and in that said sequence comprises a pattern of injections and interruptions other than a pattern that is sub-divisible into identical sub-sequences.

* * * * *